US011098436B2

(12) United States Patent
Leibman

(10) Patent No.: US 11,098,436 B2
(45) Date of Patent: Aug. 24, 2021

(54) ADDITIVE RESERVOIR RECEPTACLE FOR AN APPLIANCE

(71) Applicant: Haier US Appliance Solutions, Inc., Wilmington, DE (US)

(72) Inventor: Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 88 days.

(21) Appl. No.: 16/507,284

(22) Filed: Jul. 10, 2019

(65) Prior Publication Data

US 2021/0010184 A1 Jan. 14, 2021

(51) Int. Cl.

| | |
|---|---|
| ***D06F 39/02*** | (2006.01) |
| ***D06F 39/14*** | (2006.01) |
| *D06F 21/02* | (2006.01) |

(52) U.S. Cl.

CPC ..... *D06F 39/02* (2013.01); *D06F 39/14* (2013.01); *D06F 21/02* (2013.01); *D06F 2204/08* (2013.01)

(58) Field of Classification Search

CPC ..... B67D 3/0083; A47L 15/4418; A47L 15/4472; D06F 33/37; D06F 33/47; D06F 33/57; D06F 33/74; D06F 34/08; D06F 34/10; D06F 34/20; D06F 37/42; D06F 39/02; D06F 39/022; D06F 39/14; D06F 58/203; D06F 2103/22; D06F 2103/40; D06F 2105/44; D06F 2105/58; D06F 2105/60

See application file for complete search history.

(56) References Cited

U.S. PATENT DOCUMENTS

| | | | | |
|---|---|---|---|---|
| 1,829,353 | A * | 10/1931 | Hogan | B67D 3/0083 248/143 |
| 3,289,949 | A | 12/1966 | Roth | |
| 6,478,440 | B1 | 11/2002 | Jaworski et al. | |
| 6,581,915 | B2 | 6/2003 | Bartsch et al. | |
| 6,840,068 | B2 | 1/2005 | Pasin et al. | |
| 7,340,790 | B2 | 3/2008 | Aouad et al. | |
| 8,770,557 | B2 | 7/2014 | Kanel | |
| 8,980,014 | B2 * | 3/2015 | Classen | A47L 15/4445 134/58 D |
| 9,988,756 | B2 | 6/2018 | Bae et al. | |
| 2002/0066798 | A1 | 6/2002 | Laudamiel-Pellet et al. | |
| 2002/0068009 | A1 | 6/2002 | Laudamiel-Pellet et al. | |
| 2002/0068010 | A1 | 6/2002 | Laudamiel-Pellet et al. | |
| 2005/0147523 | A1 | 7/2005 | Laudamiel-Pellet et al. | |
| 2006/0196100 | A1 | 9/2006 | Laudamiel-Pellet et al. | |
| 2006/0251541 | A1 | 11/2006 | Santandrea | |
| 2013/0000781 | A1 | 1/2013 | Bischoff | |
| 2014/0075684 | A1 * | 3/2014 | Kim | D06F 39/088 8/137 |
| 2017/0107656 | A1 * | 4/2017 | Kim | D06F 39/087 |

FOREIGN PATENT DOCUMENTS

| | | |
|---|---|---|
| EP | 1543844 A2 | 6/2005 |
| KR | 1287963 B1 | 7/2013 |

* cited by examiner

*Primary Examiner* — David G Cormier
(74) *Attorney, Agent, or Firm* — Dority & Manning, P.A.

(57) ABSTRACT

An additive dispenser for an appliance includes a rotatable door, a clip and a manifold. The clip is positioned on the rotatable door. The clip is configured for receipt of an additive bottle with a valve. The clip is positioned on the rotatable door such that the valve of the additive bottle is opened by the manifold when the additive bottle is received by the clip and the rotatable door is closed.

17 Claims, 6 Drawing Sheets

ADDITIVE RESERVOIR RECEPTACLE FOR AN APPLIANCE

CROSS-REFERENCE TO OTHER APPLICATION

U.S. patent application Ser. No. 16/371,259 describes a removable additive container for laundry appliance and is incorporated in its entirety herein for all purposes.

FIELD OF THE INVENTION

The present subject matter relates generally to additive dispensers for appliances.

BACKGROUND OF THE INVENTION

Laundry appliances, such as washing machine appliances, dryer appliances, and washer/dryer combination appliances, generally include a cabinet and a drum rotatably mounted within the cabinet. For example, conventional dryer appliances typically include a cabinet having a rotatable drum for tumbling clothes and other articles therein. As another example, conventional washing machine appliances typically includes a rotatable drum/basket that spins within a wash tub to agitate articles, to wring wash fluid from articles, etc.

One or more additives are frequently added to articles within the drum. For instance, additives may be provided to clean articles, reduce wrinkling, provide a pleasant scent, soften fabric, etc. Known additive dispensers have various drawbacks, including a high likelihood of spills.

BRIEF DESCRIPTION OF THE INVENTION

Aspects and advantages of the invention will be set forth in part in the following description, or may be apparent from the description, or may be learned through practice of the invention.

In a first example embodiment, an appliance includes a cabinet. A drum is disposed within the cabinet. An additive dispenser includes a door rotatably mounted to the cabinet. A clip is positioned on the door. The clip is configured for receipt of an additive bottle with a valve. A manifold is positioned within the cabinet. The clip is positioned on the door such that the valve of the additive bottle is opened by the manifold when the additive bottle is received by the clip and the door is rotated closed.

In a second example embodiment, an additive dispenser for an appliance includes a rotatable door, a clip and a manifold. The clip is positioned on the rotatable door. The clip is configured for receipt of an additive bottle with a valve. The clip is positioned on the rotatable door such that the valve of the additive bottle is opened by the manifold when the additive bottle is received by the clip and the rotatable door is closed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
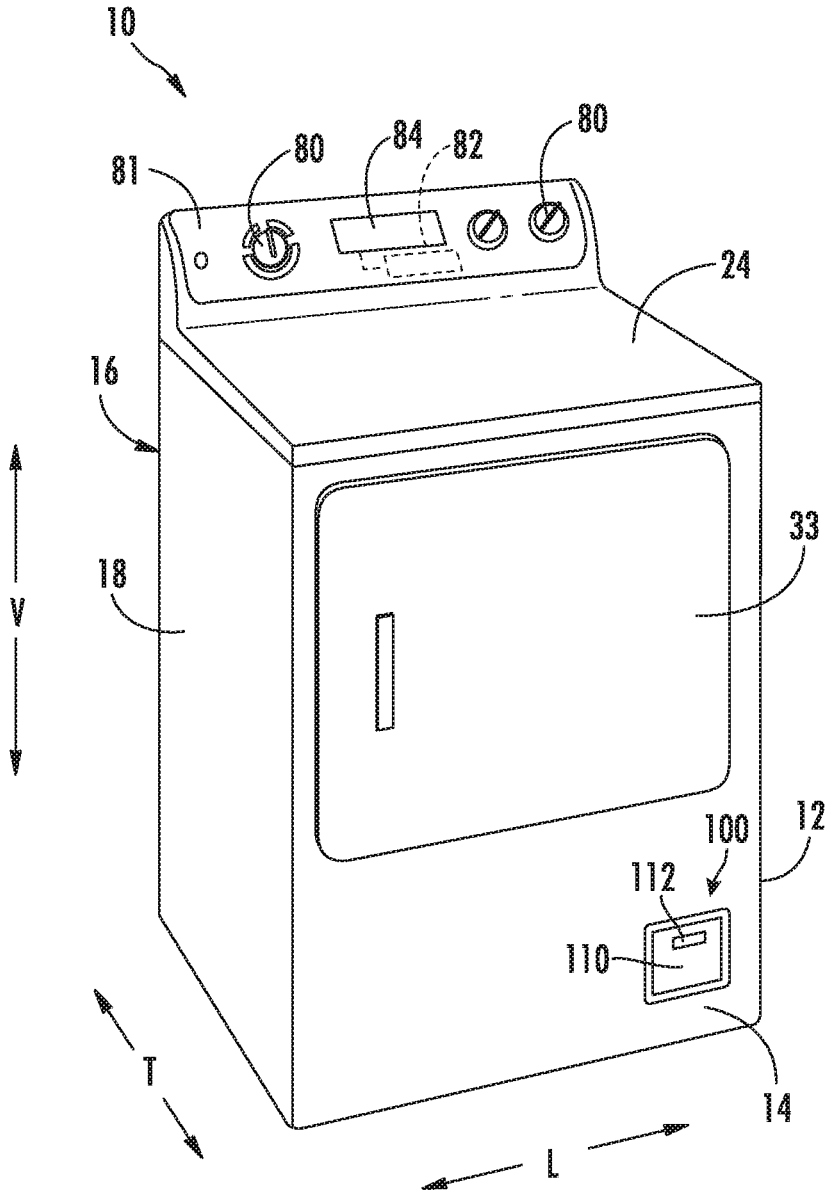
FIG. 1 is a perspective view of a dryer appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
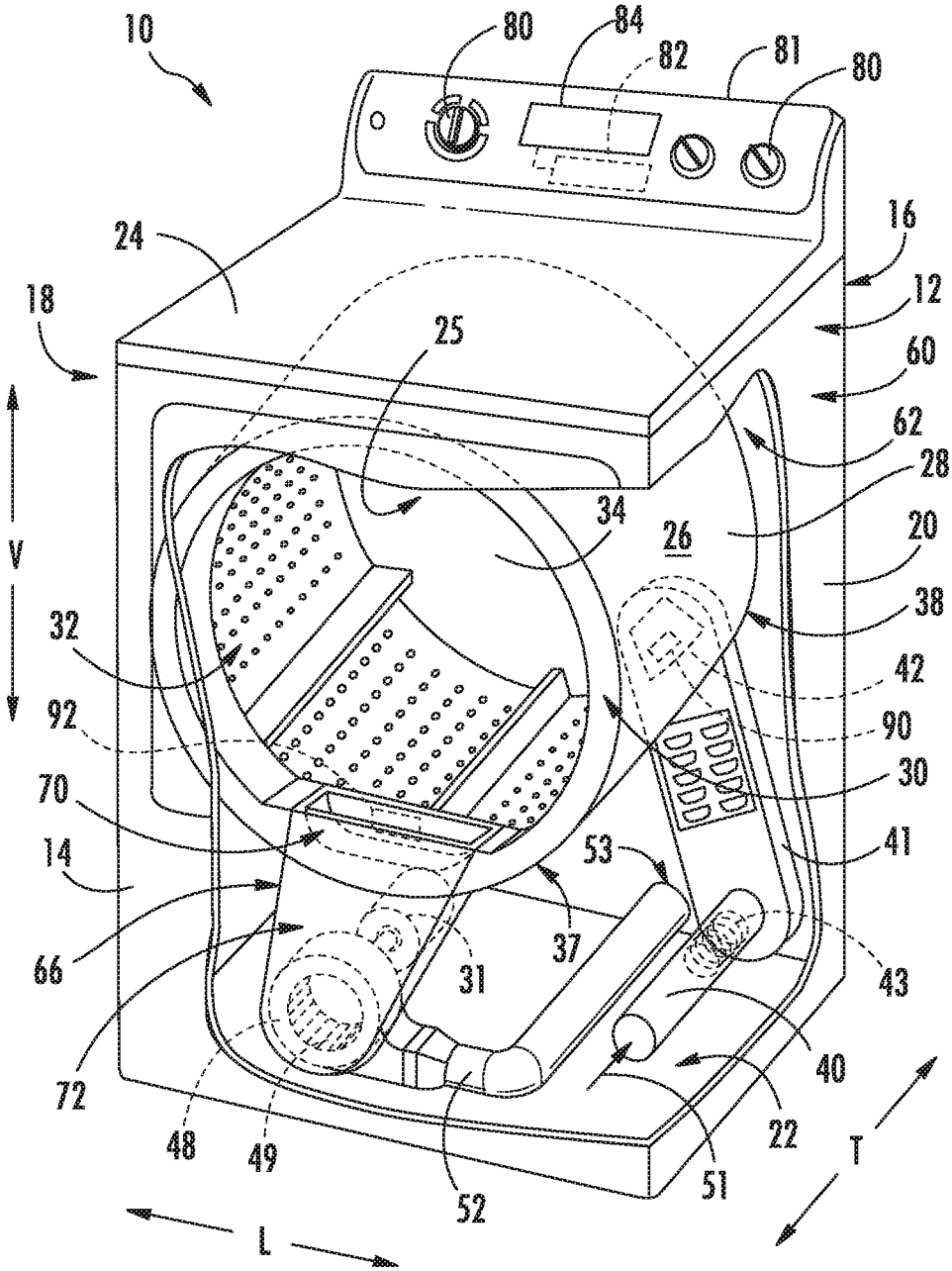
FIG. 2 is a perspective view of the example dryer appliance of FIG. 1 that shows certain internal components of the example dryer appliance.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. It will be understood that the present subject matter may also be used with other appliances in alternative example embodiments. For example, an additive dispenser 100, described in greater detail below, may be used in or with washing machine appliances, dishwasher appliances, etc. in alternative example embodiments. Thus, while described in greater detail below in the context of dryer appliance 10, the present subject matter may be used in or with any suitable appliance in alternative example embodiments.

Dryer appliance 10 defines a vertical direction V, a lateral direction L, and a transverse direction T. The vertical direction V, lateral direction L, and transverse direction T are mutually perpendicular and form and orthogonal direction system. Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of cabinet 12 and an interior 62 of cabinet 12. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the transverse direction T. In exemplary embodiments, drum 26 is rotatable, e.g., about an axis that is parallel to the transverse direction T, within cabinet 12.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. Rear wall 34 of drum 26 may be fixed relative to cabinet 12, e.g., such that cylinder 28 of drum 26 rotates on rear wall 34 of drum 26 during operation of dryer appliance 10.

A motor 31 may be in mechanical communication with a blower 48 such that motor 31 rotates a blower fan 49 of blower 48. Blower 48 is configured for drawing air through chamber 25 of drum 26, e.g., in order to dry articles located therein, as discussed in greater detail below. In alternative exemplary embodiments, dryer appliance 10 may include an additional motor (not shown) for rotating fan 49 of blower 48 independently of drum 26.

Drum 26 may be configured to receive heated air that has been heated by a heating assembly 40, e.g., in order to dry damp articles disposed within chamber 25 of drum 26. Heating assembly 40 includes a heater 43, such as a gas burner or an electrical resistance heating element, for heating air. As discussed above, during operation of dryer appliance 10, motor 31 rotates fan 49 of blower 48 such that blower 48 draws air through chamber 25 of drum 26. In particular, ambient air enters heating assembly 40 via an entrance 51 due to blower 48 urging such ambient air into entrance 51. Such ambient air is heated within heating assembly 40 and exits heating assembly 40 as heated air. Blower 48 draws such heated air through inlet duct 41 to drum 26. The heated air enters drum 26 through an outlet 42 of duct 41 positioned at rear wall 34 of drum 26.

Within chamber 25, the heated air can remove moisture, e.g., from damp articles disposed within chamber 25. This internal air in turn flows from chamber 25 through an outlet assembly 64 positioned within interior 62. Outlet assembly 64 includes a vent duct 66, blower 48, and an exhaust conduit 52. Exhaust conduit 52 is in fluid communication with vent duct 66 via blower 48. During a dry cycle, internal air flows from chamber 25 through vent duct 66 to blower 48 and through blower 48 to exhaust conduit 52. The internal air is exhausted from dryer appliance 10 via exhaust conduit 52.

In exemplary embodiments, vent duct 66 can include a filter portion 70 and an exhaust portion 72. Exhaust portion 72 may be positioned downstream of filter portion 70 (in the direction of flow of the internal air). A screen filter of filter portion 70 (which may be removable) traps lint and other particulates as the internal air flows therethrough. The internal air may then flow through exhaust portion 72 and blower 48 to exhaust conduit 52. After the clothing articles have been dried, the clothing articles are removed from drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate motor 31 and heating assembly 40, including heater 43, in response to the position of selector inputs 80. Additionally, a display 84, such as an indicator light or a screen, may be provided on cabinet backsplash 82. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

In some embodiments, dryer appliance 10 may additionally include one or more sensors. For example, dryer appliance 10 may include one or more temperature sensors 90. Temperature sensor 90 is operable to measure internal temperatures in dryer appliance 10. In some embodiments, for example, temperature sensor 90 may be disposed in inlet duct 41, such as at outlet 42 of inlet duct 41, which corresponds to an inlet to drum 26. Additionally or alternatively, for example, temperature sensor 90 may be disposed in drum 26, such as in chamber 25 thereof, at an outlet of drum 26 such as in vent duct 66, or in any other suitable location within dryer appliance 10. Temperature sensors 90 may be in communication with controller 82, and may transmit readings to controller 82 as required or desired.

Dryer appliance 10 may further include, for example, a dampness or moisture sensor 92. Moisture sensor 92 is operable to measure the dampness or moisture content of articles within chamber 25 during operation of dryer appliance 10. In particular, moisture sensor 92 may measure voltages associated with dampness or moisture content within the clothing, as is generally understood. Moisture sensor 92 may be positioned proximate filter portion 70. In alternative exemplary embodiments, moisture sensor 92 may be disposed at any other suitable location within dryer appliance 10, e.g., on cylinder 28, rear wall 34, etc. Moisture sensor 92 may be in communication with controller 82, and may transmit readings to controller 82 as required or desired.

Dryer appliance 10 also includes an additive dispenser 100. Additive dispenser 100 is operable to dispense an additive, such as a scent or fragrance loaded fluid, into chamber 25 (FIG. 2) of dryer appliance 10. Thus, additive dispenser 100 may be a scent/fragrance dispenser in certain example embodiments. As an example, additive dispenser 100 may be in fluid communication with one or more spray nozzles (not shown) which are positioned and arranged to provide a spray of additive from additive dispenser 100 into chamber 25 of dryer appliance 10, such as onto clothing articles therein. Additive dispenser 100 is described in greater detail below with reference to FIGS. 3 through 7.

Figure 3:
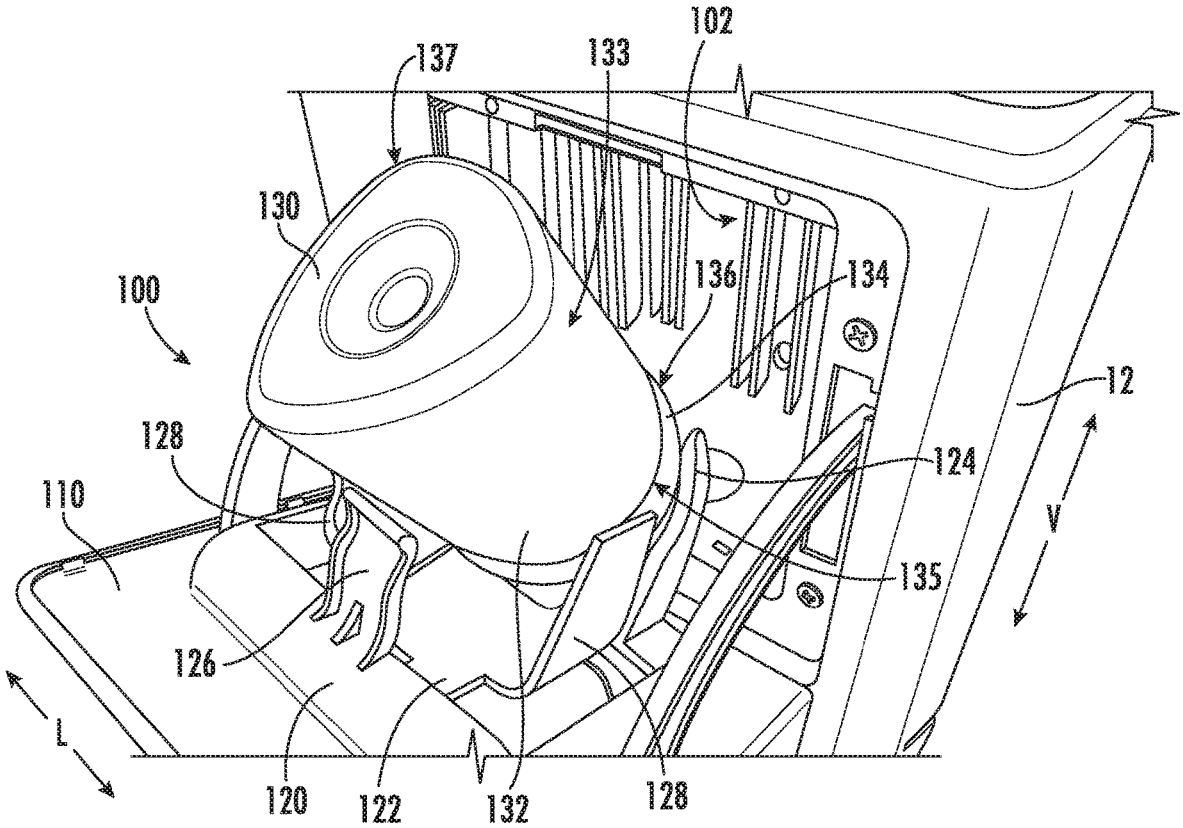
FIG. 3 is a perspective view of an additive dispenser of the example dryer appliance of FIG. 1 with a door of the additive dispenser shown open and an additive bottle of the additive dispenser shown removed from a clip of the additive dispenser.
Figure 4:
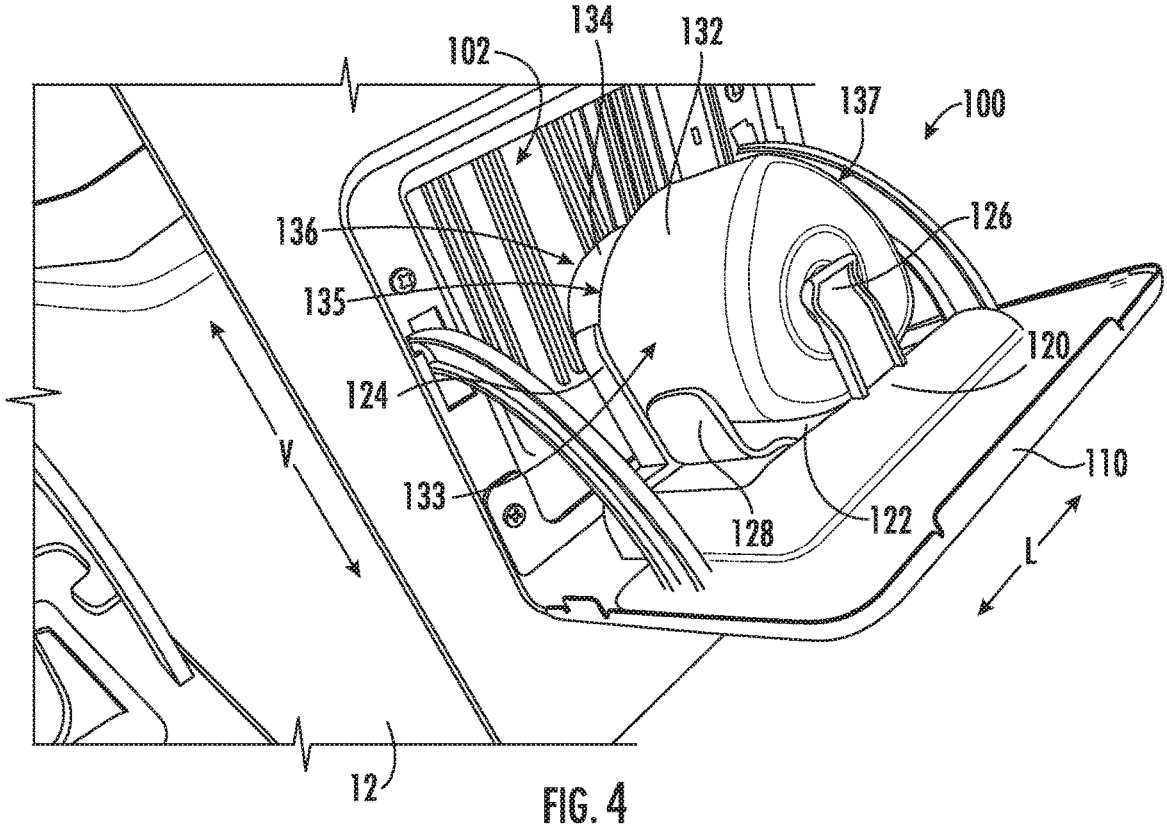
FIG. 4 is another perspective view of the additive dispenser of the example dryer appliance of FIG. 1 with the door of the additive dispenser shown open and the additive bottle of the additive dispenser shown mounted to the clip of the additive dispenser.

As shown in FIGS. 3 and 4, additive dispenser 100 includes a door 110. Door 110 is rotatably mounted to cabinet 12. Thus, door 110 may rotated open and closed to access components of additive dispenser 100 within cabinet 12. As shown in FIG. 1, door 110 may be rotatably mounted to front panel 14 of cabinet 12. Thus, additive dispenser 100 may advantageously be visible and accessible from the front of dryer appliance 10.

Additive dispenser 100 also includes a clip 120 positioned on door 110. Thus, clip 120 rotates with door 110 as door 110 rotates open and closed. Clip 120 is configured for receipt of an additive bottle 130. Thus, clip 120 may removably mount additive bottle 130 on door 110 such that additive bottle 130 rotates with door 110 as door 110 rotates open and closed. Additive bottle 130 may be positioned within an interior 102 of additive dispenser 100 (e.g., within cabinet 12) on clip 120 when door 110 is closed. Conversely, additive bottle 130 may be positioned outside of interior 102 of additive dispenser 100 (e.g., and thus outside cabinet 12) on clip 120 when door 110 is open.

Clip 120 may include a base plate 122, a pair of bottom projections 124 and a top projection 126. Base plate 122 may be mounted to door 110. For example, base plate 122 may be fastened, adhered, or otherwise suitably fixed to door 110 such that base plate 122 is rotatable with door 110. Bottom projections 124 and top projection 126 may extend from base plate 122, e.g., such that bottom projections 124 and top projection 126 are cantilevered from base plate 122. Thus, bottom projections 124 and top projection 126 may elastically deform when additive bottle 130 is mounted to door 110 with clip 120. Side supports 128 of clip 120 may also support additive bottle 130, e.g., between bottom projections 124 and top projection 126.

Additive bottle 130 is filled or fillable with a fluidic additive, such as a fragrance or scent. Thus, e.g., additive bottle 130 may include a reservoir 132 and a cap 134. Reservoir 132 may be configured for receipt and storage of the fluidic additive, e.g., within an internal volume 133 of reservoir 132. Cap 134 is removably connected to an open end 135 of reservoir 132 to selectively enclose internal volume 133 of reservoir 132. For example, cap 134 may be threadedly connected to open end 135 of reservoir 132. When cap 134 is connected to reservoir 132, internal volume 133 of reservoir 132 may thereby be enclosed such that additive within internal volume 133 is prevented or obstructed from flowing out of additive bottle 130 other than via an outlet of additive bottle 130, as described in greater detail below. When cap 134 is removed from reservoir 132, internal volume 133 may be filled with the fluidic additive via open end 135 of reservoir 132.

As noted above, additive bottle 130 is mountable to door 110 with clip 120. As an example, bottom and top projections 124, 126 of clip 120 may cooperate to removably mount additive bottle 130 to door 110. In particular, bottom projections 124 of clip 120 may be spaced such that a first end portion 136 of additive bottle 130 is receivable between bottom projections 124 of clip 120. In particular, cap 134 may be mounted to reservoir 132 at first end portion 136 of additive bottle 130, and bottom projections 124 of clip 120 may be spaced such that cap 134 of additive bottle 130 is receivable between bottom projections 124 of clip 120. In addition, top projection 126 of clip 120 may be positioned between bottom projections 124, e.g., along the lateral direction L, and may also be spaced from bottom projections 124, e.g., along the vertical direction V when door 110 is closed. Top projection 126 of clip 120 may be positioned relative to bottom projections 124 of clip 120 for engaging a second end portion 137 of additive bottle 130 that is opposite first end portion 136 of additive bottle 130. Thus, top projection 126 of clip 120 may be positioned for engaging against the closed end of reservoir 132 that is opposite cap 134 and open end 135 of reservoir 132. The above described positioning of top projection 126 may advantageously limit or prevent upward movement of additive bottle 130 on door 110 as door 110 rotates closed, and the above described positioning of bottom projections 124 may advantageously align a valve 140 on additive bottle 130 for actuation by other components of additive dispenser 100 as door 110 rotates closed.

Figure 5:
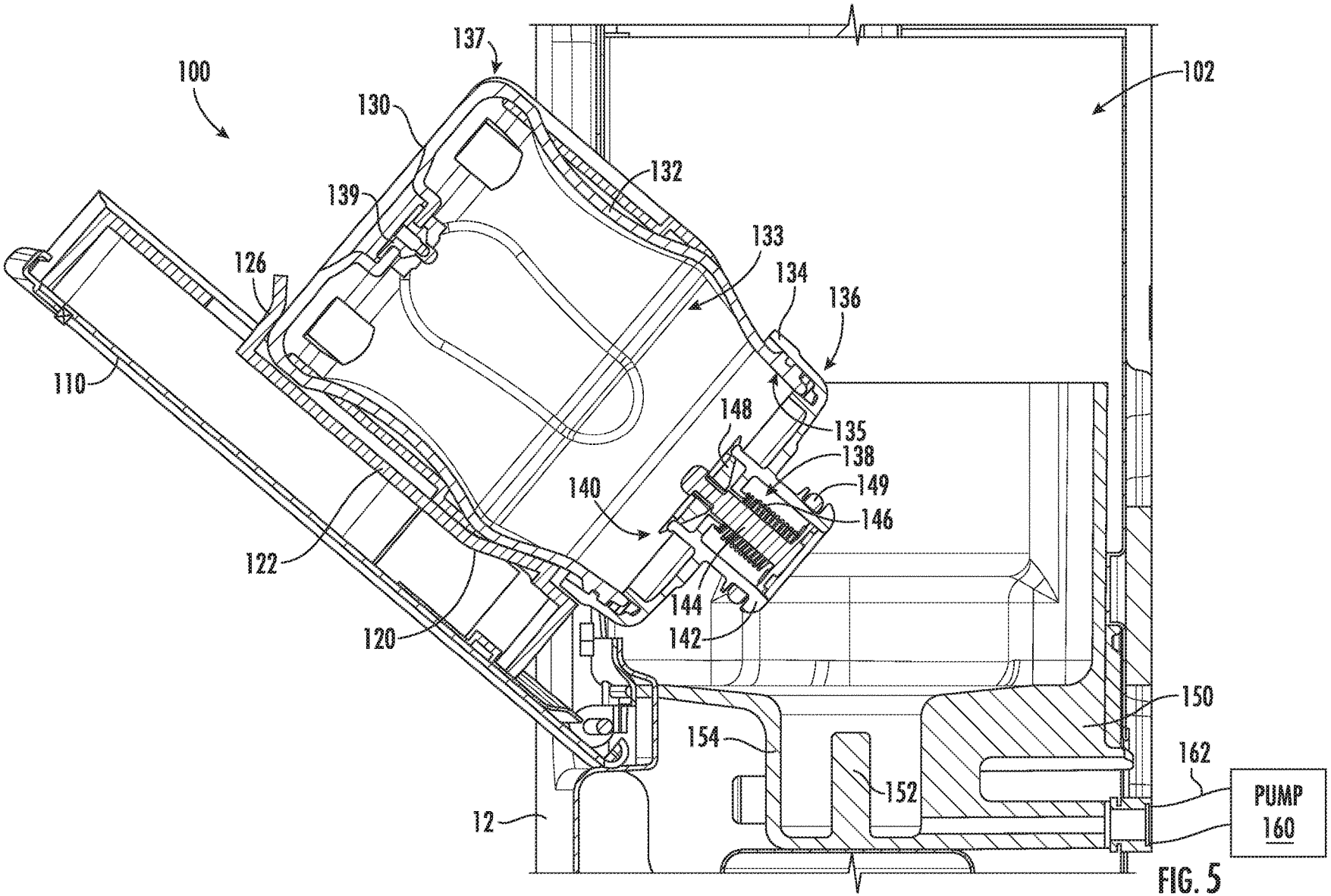
FIGS. 5, 6 and 7 are section views of the additive dispenser of the example dryer appliance of FIG. 1 with the door of the additive dispenser shown in various positions as the door rotates closed and with the additive bottle of the additive dispenser shown mounted to the clip of the additive dispenser.
Figure 6:
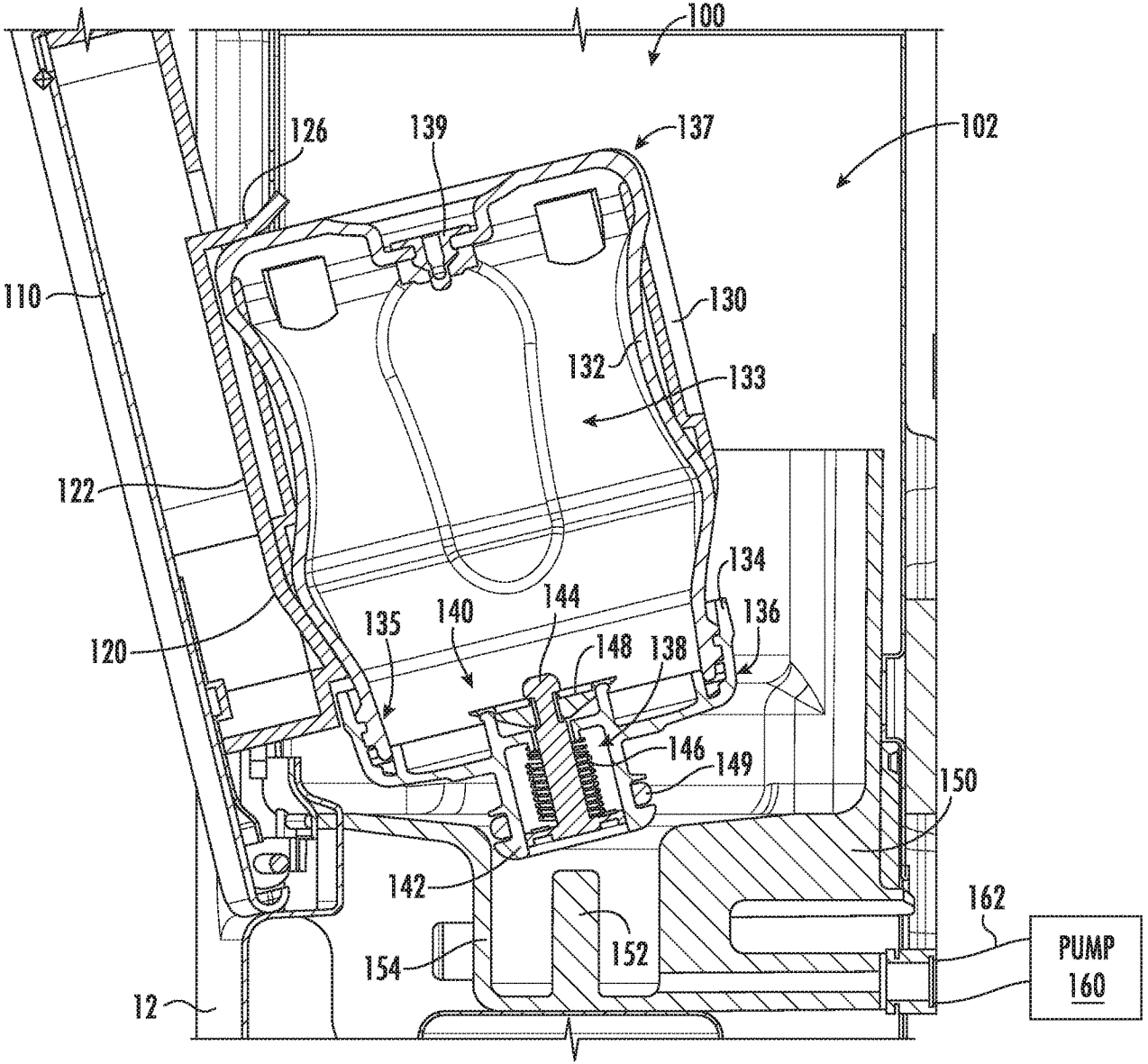
Figure 7:
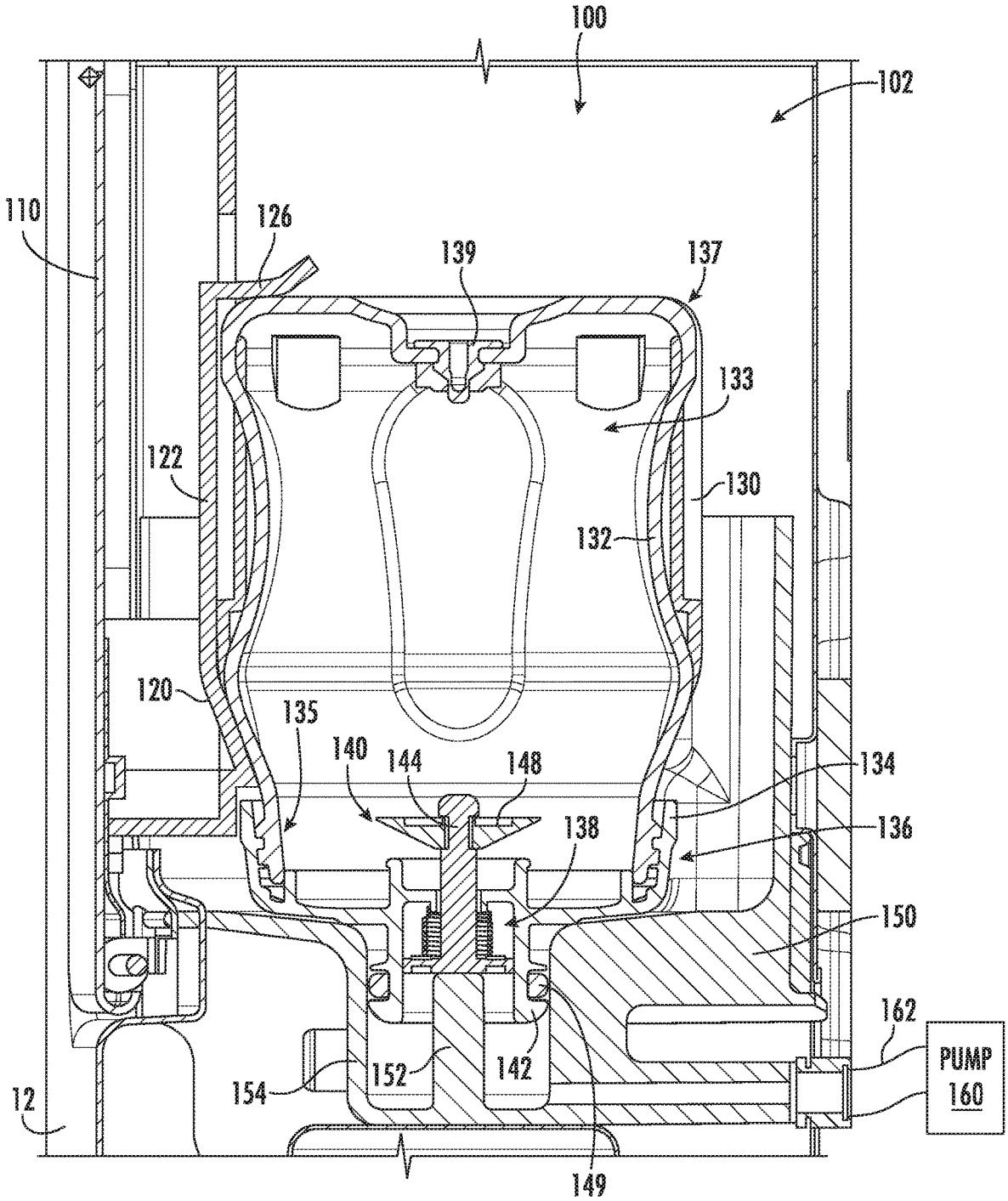

Turning now to FIGS. 5 through 7, additive dispenser 100 includes features for opening valve 140 of additive bottle 130 when additive bottle 130 is mounted to clip 120 and door 110 is closed. In particular, additive dispenser 100 includes a manifold 150 positioned within cabinet 12 of dryer appliance 10. Clip 120 is positioned on door 110 such that valve 140 of additive bottle 130 is opened by manifold 150 when additive bottle 130 is received by clip 120 and door 110 is rotated closed.

Manifold 150 may include an actuation pin 152 and a cylindrical support 154. Actuation pin 152 is, e.g., concentrically, disposed within cylindrical support 154. Cylindrical support 154 is configured for receipt of an outlet passage 138 of additive bottle 130. Actuation pin 152 may be positioned within cylindrical support 154 such that actuation pin 152 engages and opens valve 140 when door 110 rotates closed and additive bottle 130 engages manifold 150.

Valve 140 is positioned at outlet passage 138 of additive bottle 130 and is configured to selectively allow additive within internal volume 133 of additive bottle 130 to flow out of additive bottle 130 via outlet passage 138. Valve 140 may include a valve body 142, a post 144, a spring 146 and a seal 148. Valve body 142 may be integrated into cap 134 of additive bottle 130 as shown in FIG. 5 such that valve body 142 is formed from the same material, such as plastic, as cap 134. In alternative example embodiments, valve body 142 may be mounted to or formed with reservoir 132. Post 144 of valve 140 is slidably mounted to valve body 142, and seal 148 is positioned on post 144, e.g., such that seal 148 moves with post 144. Seal 148 may be positioned on post 144 such that seal 148 is positioned against valve body 142 and seals outlet passage 138 when valve 140 is closed. Conversely, when post 144 slides relative to valve body 142 and valve 140 is open, seal 148 may be spaced from valve body 142 to allow additive to flow out of internal volume 133 of additive bottle 130 via outlet passage 138. Spring 146 may be coupled to post 144 such that spring 146 urges seal 148 towards and/or against valve body 142. Thus, valve 140 may be normally closed.

An O-ring 149 on valve body 142 may also extend radially between additive bottle 130 and manifold 150 (e.g., inner surface of cylindrical support 154) when valve 140 is open to limit leakage of additive at the connection between additive bottle 130 and manifold 150. Actuation pin 152 may be positioned such that actuation pin 152 engages post 144 of valve 140 and thereby slides post 144 relative to valve body 142 in order to space seal 148 from valve body 142 and thus open valve 140 when additive bottle 130 is received by clip 120 and door 110 is rotated closed.

Rotation of door 110 to open valve 140 will now be described in greater detail below with reference to FIGS. 5 through 7. As shown in FIG. 5, door 110 may be rotated to an open position. In the open position, clip 120 is accessible to a user of additive dispenser 100. Thus, the user may attach additive bottle 130 to clip 120 and/or remove additive bottle 130 from clip 120 when door 110 is in the open position. The user may manually rotate door 110 to the position by grasping the top edge of door or a handle 112 (FIG. 1) on door 110. When door 110 is in the open position, valve 140 is spaced from manifold 150. Thus, valve 140 may be closed, and valve 140 may block an outflow of additive from additive bottle 130. In particular, spring 146 may urge seal 148 against valve body 142 such that seal 148 blocks outlet passage 138 of additive bottle 130 and prevents additive within additive bottle 130 from flowing out of additive bottle 130 via outlet passage 138.

As noted above, in the open position, the user of additive dispenser 100 may attach additive bottle 130 to clip 120 such that additive bottle 130 is fixed relative to door 110. Thus, as shown in FIG. 6, as the user rotates door 110 towards the closed position (FIG. 7), additive bottle 130 rotates with door 110 due to connection between additive bottle 130 and door 110 provided by clip 120. As shown in FIG. 7, when door 110 is in the closed position, valve 140 is opened by manifold 150. In particular, the user may rotate door 110 from the intermediate position shown in FIG. 6 to the closed position shown in FIG. 7, and actuation pin 152 may engage post 144 of valve 140 to open valve 140 as the door 110 rotates closed. In particular, when post 144 of valve 140 impacts actuation pin 152, the interference between actuation pin 152 and post 144 causes post 144 to slide relative to valve body 142. In turn, the movement of post 144 relative to valve body 142 moves seal 148 away from valve body 142 as shown in FIG. 7. When seal 148 is spaced from valve body 142, internal volume 133 is in fluid communication with outlet passage 138, and additive within additive bottle 130 may flow out of additive bottle 130 via outlet passage 138. As may be seen from the above, mounting clip 120 to door 110 may advantageously constrain the location of additive bottle 130 relative to manifold 150 such that rotating door 110 closed opens valve 140 and allows additive to flow out of additive bottle 130, e.g., without spilling.

Additive dispenser 100 may also include features for selectively flowing additive from within additive bottle 130 to chamber 25. As shown in FIG. 5, additive dispenser 100 may include a pump 160 and a hose 162. Pump 160 is positioned within cabinet 12. Pump 160 is coupled to manifold 150 such that pump 160 is operable to flow additive from within additive bottle 130. Thus, when additive bottle 130 is received by clip 120 and door 110 is closed such that valve 140 is open, pump 160 may draw additive out of additive bottle 130. Hose 162 may extend between pump 160 and manifold 150 to place such components in fluid communication and provide a fluid flow path for additive from additive bottle 130 between pump 160 and manifold 150. Thus, pump 160 may urge such additive into chamber 25, as noted above. Additive bottle 130 may include an air vent 139 to assist operation of pump 160. Air vent 139 may be positioned opposite valve 140, e.g., on second end portion 137 of additive bottle 130. During operation of pump 160, air may flow into internal volume 133 via air vent 139. Air vent 139 may be a suitable one-way check valve that allows fluid flow into additive bottle 130 but blocks fluid flow out of additive bottle 130.

In various example embodiments, additive may be supplied by additive dispenser 100 only when a specific set of operating parameters exist, e.g., in embodiments where the laundry appliance is a dryer appliance 10, when heating system 40 is off and drum 26 is spinning. For example, supplying additive when the heating system 40 is off may occur immediately after a drying cycle, or following a short delay, e.g., a few seconds, after a drying cycle. As such, clothes within chamber 25 may still be warm, e.g., at an elevated temperature relative to room temperature, when the additive is sprayed into chamber 25, which may promote or enhance the effects of certain additives such as fragrances. Rotation of drum 26 while spraying the additive may promote even distribution of the additive on clothes within chamber 25, and in some cases may provide additional benefits. For example, when the additive includes a wrinkle releaser, agitation of the clothes due to rotation of the basket 26 may increase effectiveness of the wrinkle releaser. In some embodiments, the additive may be supplied in response to a user selection, which may be selected via one or more of inputs 80. For example, a dedicated "refresh" cycle and/or "add scent" option for one or more standard laundry appliance cycles may be provided.

Additive dispenser 100 and removable additive bottle 130 provide several advantages over previous systems, as will be recognized by those of skill in the art. For example, additive bottle 130 may be conveniently accessed via door 110. As another example, additive bottle 130 may be easily disassembled, e.g., cap 134 and reservoir 132 may be easily separated such as by unscrewing, to allow a user to rinse additive bottle 130, to refill additive bottle 130 with any desired additive, etc. As an additional example, the user may be permitted to easily carry additive bottle 130 to another location, such as a sink, e.g., in a laundry room or kitchen, for cleaning or a storage location where replacement additive may be stored for refilling. As a further example, additive bottle 130 is generally spill-proof or spill resistant, such that when the user returns the container 218 to appliance 10 after refilling additive bottle 130 at the other location (e.g., away from appliance 10), valve 140 may prevent or reduce undesired release of additive from additive bottle 130, including when additive bottle 130 is upright (e.g., with cap 134 above reservoir 132) and when additive bottle 130 is inverted (e.g., with cap 134 below reservoir 132). In addition, clip 120 may conveniently connect door 110 and additive bottle 130 such that closing of door 110 opens valve 140. Utilizing clip 120, valve 140 is reliably actuated without requiring manual insertion of additive bottle 130 into manifold 150. Thus, the risk of additive spills due to inadvertent opening of valve 140 is conveniently avoided.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:
a cabinet;
a drum disposed within the cabinet;
an additive bottle comprising a valve; and
an additive dispenser comprising
a door rotatably mounted to the cabinet,
a clip positioned on the door, the clip configured for receipt of the additive bottle, and
a manifold positioned within the cabinet,
wherein the clip is positioned on the door such that the valve of the additive bottle is opened by the manifold when the additive bottle is received by the clip and the door is rotated closed,
wherein the clip comprises a base plate, a pair of bottom projections and a top projection, the base plate mounted to the door, the pair of bottom projections and the top projection extending from the base plate, the pair of bottom projections spaced such that an end portion of the additive bottle is receivable between the pair of bottom projections, the top projection positioned laterally between the pair of bottom projections.

2. The appliance of claim 1, wherein the additive dispenser further comprises a pump positioned within the cabinet, the pump coupled to the manifold such that the pump is operable to flow fluid from the additive bottle when the additive bottle is received by the clip and the door is closed.

3. The appliance of claim 2, wherein the additive dispenser further comprises a hose that extends between the pump and the manifold, and the hose provides a fluid flow path between the pump and the manifold.

4. The appliance of claim 2, wherein the pump is operable to flow the fluid from the additive bottle into the drum.

5. The appliance of claim 1, wherein the manifold comprises an actuation pin and a cylindrical support, the actuation pin disposed within the cylindrical support.

6. The appliance of claim 5, wherein the valve of the additive bottle comprises a valve body, a post, a spring and a seal, the post slidably mounted to the valve body, the seal positioned on the post such that the seal is positioned against the valve body when the valve is closed, the spring coupled to the post such that the spring urges the seal towards the valve body.

7. The appliance of claim 6, wherein the actuation pin is positioned such that the actuation pin engages the post of the valve and spaces the seal from the valve body in order to open the valve when the additive bottle is received by the clip and the door is rotated closed.

8. The appliance of claim 1, wherein the additive bottle comprises an air vent positioned opposite the valve on the additive bottle.

9. The appliance of claim 1, wherein the appliance is a dryer appliance or a washing machine appliance.

10. An additive dispenser for an appliance, comprising:

a rotatable door;

an additive bottle comprising a valve;

a clip positioned on the rotatable door, the clip configured for receipt of the additive bottle; and a manifold, wherein the clip is positioned on the rotatable door such that the valve of the additive bottle is opened by the manifold when the additive bottle is received by the clip and the rotatable door is closed, wherein the clip comprises a base plate, a pair of bottom projections and a top projection, the base plate mounted to the rotatable door, the pair of bottom projections and the top projection extending from the base plate, the pair of bottom projections spaced such that an end portion of the additive bottle is receivable between the pair of bottom projections, the top projection positioned laterally between the pair of bottom projections.

11. The additive dispenser of claim 10, further comprising a pump, the pump coupled to the manifold such that the pump is operable to flow fluid from the additive bottle when the additive bottle is received by the clip and the rotatable door is closed.

12. The additive dispenser of claim 11, further comprising a hose that extends between the pump and the manifold, and the hose provides a fluid flow path between the pump and the manifold.

13. The additive dispenser of claim 11, wherein the pump is operable to flow the fluid from the additive bottle into a drum.

14. The additive dispenser of claim 10, wherein the manifold comprises an actuation pin and a cylindrical support, the actuation pin disposed within the cylindrical support.

15. The additive dispenser of claim 14, wherein the valve of the additive bottle comprises a valve body, a post, a spring and a seal, the post slidably mounted to the valve body, the seal positioned on the post such that the seal is positioned against the valve body when the valve is closed, the spring coupled to the post such that the spring urges the seal towards the valve body.

16. The additive dispenser of claim 15, wherein the actuation pin is positioned such that the actuation pin engages the post of the valve and spaces the seal from the valve body in order to open the valve when the additive bottle is received by the clip and the rotatable door is closed.

17. The additive dispenser of claim 10, wherein the additive bottle comprises an air vent positioned opposite the valve on the additive bottle.

* * * * *